United States Patent [19]

Collis

[11] 4,382,309

[45] May 10, 1983

[54] TOOTHBRUSH

[76] Inventor: George C. Collis, 313 W. 48th St., Minneapolis, Minn. 55407

[21] Appl. No.: 175,424

[22] Filed: Aug. 5, 1980

[51] Int. Cl.[3] ..... A46B 9/04

[52] U.S. Cl. ..... 15/167 A; 15/110; 300/21

[58] Field of Search ..... 15/167 R, 167 A, 110

[56] References Cited

U.S. PATENT DOCUMENTS

| | | | |
|---|---|---|---|
| 2,097,987 | 11/1937 | Phillips | 15/167 R |
| 3,100,309 | 8/1963 | Gambino | 15/167 R |
| 3,903,906 | 9/1975 | Collis | 15/167 R |

FOREIGN PATENT DOCUMENTS

| | | | |
|---|---|---|---|
| 2449513 | 4/1976 | Fed. Rep. of Germany | 15/167 R |

*Primary Examiner*—Peter Feldman

*Attorney, Agent, or Firm*—Mark C. Jacobs

[57] ABSTRACT

A toothbrush is disclosed which is capable of cleaning the buccal-labial and lingual surfaces of teeth simultaneously. The method of fabricating the toothbrush is also disclosed. The toothbrush includes a bristle mounting head, a holder for supporting the bristle mounting head and a plurality of cleaning bristles on the bristle mounting head, with the cleaning bristles being in the form of two arcuate or angular shaped bundles of nylon filaments, whose ends are spaced apart and opposed to each other. When the toothbrush is placed over teeth to be cleaned the tips of the bristles at the ends of the bundle rub against opposite surfaces of the teeth. The toothbrush may be made by winding a nylon monofilament around a mandrel an appropriate number of times, setting the windings to the cylindrical shape, bonding the windings together, removing the cylinder from the mandrel, cutting away a section of the cylinder and then attaching the remaining section of the cylinder to a bristle mounting head attached to a toothbrush holder, in one embodiment.

7 Claims, 12 Drawing Figures

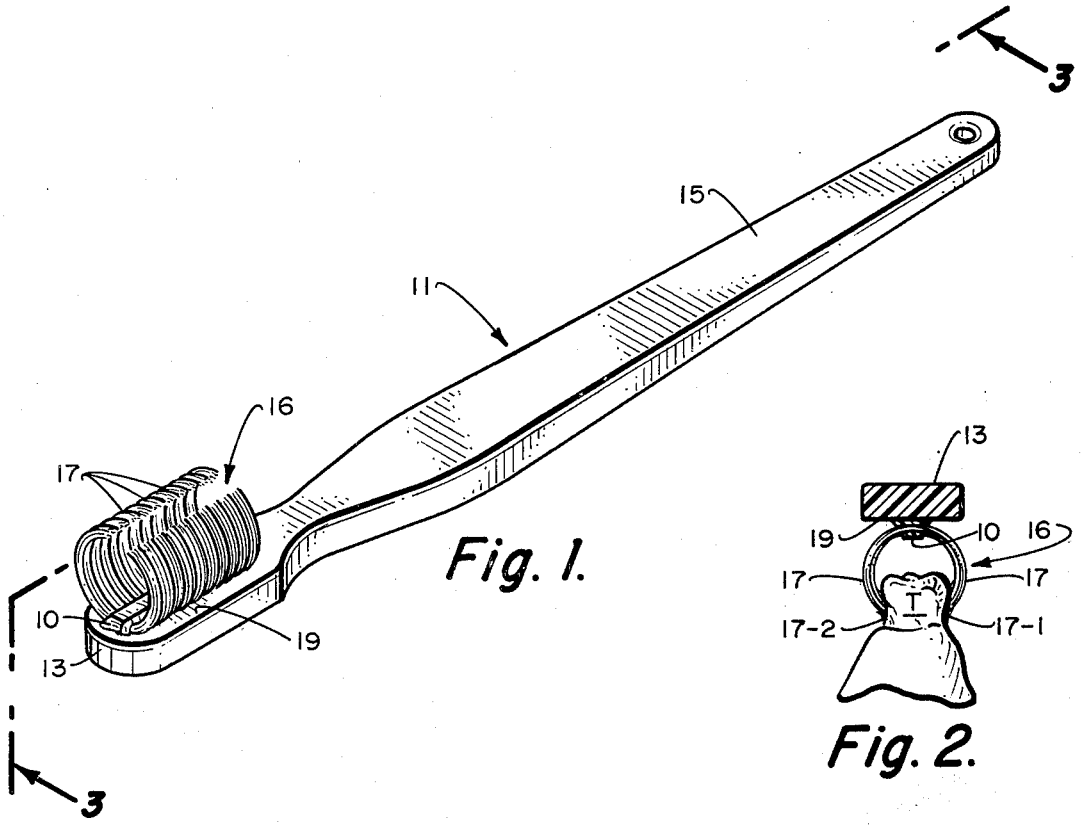
Fig. 1.
Fig. 2.
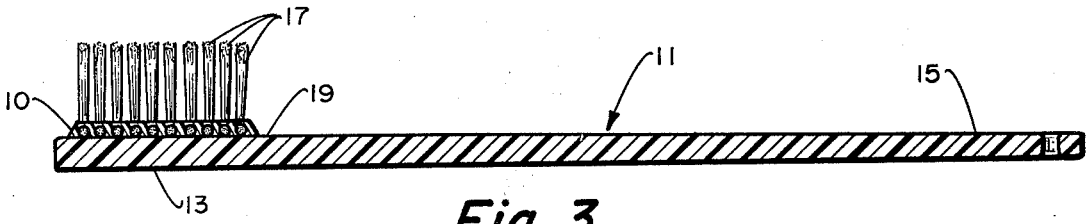
Fig. 3.
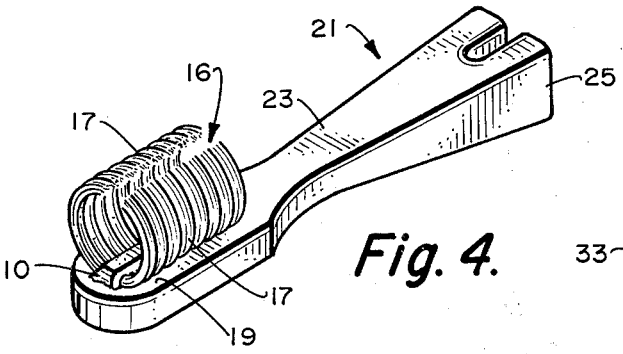
Fig. 4.
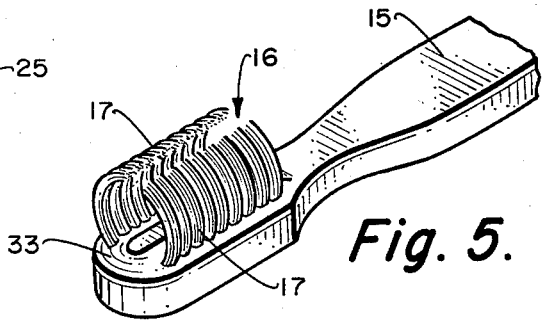
Fig. 5.

TOOTHBRUSH

BACKGROUND OF THE INVENTION

The present invention relates generally to toothbrushes and more particularly to a novel construction of a toothbrush which is specially suited for cleaning the buccal and lingual surfaces of the teeth in one brushing operation and to methods of fabricating such a toothbrush.

Toothbrushes which are capable of cleaning the buccal and lingual surfaces of the teeth simultaneously are well known to those skilled in the art. Such toothbrushes have the advantage in that they lend themselves to a more efficient cleaning operation.

In U.S. Pat. No. 741,722 to William B. Ryder and Charles L. Reynolds there is disclosed a toothbrush which is capable of brushing the buccal and lingual surfaces in one operation and which comprises two opposite diverging bristle carrying heads bearing a plurality of tufts of bristles on their inner surfaces and a V shaped spring handle member attached at its free ends to the ends of the two heads. By squeezing the two shanks of the handle member toward each other, the bristles on the two heads contact the front and back of the teeth simultaneously.

In U.S. Pat. No. 3,903,906 to George C. Collis there is disclosed another toothbrush which is capable of brushing the buccal and lingual surfaces in one operation and which comprises a pair of banks of bristles mounted on a central hub member. Each bank of bristles comprises a plurality of concentric rings in which the bristles are grouped together in the shape of radially oriented fingers extending outward from the central hub member in a "spider-leg" fashion, each finger comprising a tuft of bristles. In one embodiment of the invention a plurality of bristles also extend radially outward from the central hub member so as to provide a toothbrush capable of cleaning simultaneously the interproximal surfaces of the teeth as well as the buccal and lingual surfaces as the toothbrush is either rolled back and forth along the teeth in an oscillating motion or the tooth brush is "chewed on" in an up and down type motion. In another embodiment of the invention the central hub member is made of a compressible material which yields sufficiently to contact the finger like bristles against the buccal and lingual surfaces when chewing pressure is applied against it.

Toothbrushes which are capable of simultaneously cleaning the crown portions and either the buccal or lingual surfaces of teeth are also well known in the art.

In U.S. Pat. No. 2,292,707 to Samuel A. Mantell there is disclosed a toothbrush in which the bristles are arranged in two separate groups. The bristles in the two groups are arranged substantially at right angles to one another and result in a brush which can simultaneously brush the crown portions of the teeth and either the buccal or lingual surfaces of the teeth depending on the particular location of the bristles relative to the teeth.

Finally, toothbrushes for simultaneously brushing a plurality of tooth surfaces and which comprise a pair of brush mounting heads mounted on a single holder with each brush mounting head containing a plurality of tufts of bristles are well known in the art. An example of such a toothbrush may be found in U.S. Pat. No. 1,668,385 to Geza Szekely et al.

Reference is also made to Collis U.S. Pat. No. 3,984,890 issued Oct. 12, 1976.

SUMMARY OF THE INVENTION

It is an object of this invention to provide a new and improved toothbrush.

It is another object of this invention to provide a toothbrush which is capable of simultaneously and efficiently brushing the lingual and buccal surfaces of the teeth.

It is still another object of this invention to provide a toothbrush which is capable of simultaneously brushing the lingual and buccal surfaces of the teeth and which does not involve the use of multiple brush carrying heads or multiple groups of bristles.

It is yet still another object of this invention to provide a toothbrush which is capable of simultaneously brushing the lingual and buccal surfaces of teeth which is easy and economical to manufacture and which lends itself to mass production.

It is another object of this invention to provide a new and novel arrangement for attaching a plurality of brush cleaning bristles to the head of a toothbrush.

It is yet another object of this invention to provide a new and novel method for fabricating a toothbrush.

The above and other objects are achieved by providing a toothbrush in which the bristles are grouped together in a pair of bundles of one or more tufts therein, arcuate or angularly bent so that the tips of the bristles at one end of a bundle brush up against the anterior surfaces while the tips of the bristles at the second end of the bundles brush up against the posterior surfaces. As will become readily apparent, the novel head and brush construction is applicable for use either with a "hand operated" toothbrush or with an "electric" toothbrush.

In one embodiment, the bundles are formed by winding a nylon monofilament on a mandrel a suitable member of times, setting the windings to the cylindrical shape, fusing the windings together on the cylindrical shape, removing the cylinder from the mandrel and then removing a small section of the cylinder to leave a curved section. Alternately, the two arced bundles may be fabricated by weaving a plurality of monofilaments into an elongated rectangular strip, bending the strip into a curved shape, and then fusing the monofilaments together to form a relatively rigid shape, wherein the two bundles are joined at one end, as a mono-bundle which is then attached along its length, preferably at a midposition, to the brush carrying head.

A principle advantage of a toothbrush capable of cleaning the anterior and posterior surfaces simultaneously is that it requires less time to perform the tooth cleaning operation.

The foregoing and other objects and advantages will appear from the description to follow. In the description, reference is made to the accompanying drawings which forms a part thereof, and in which is shown by way of illustration specific embodiments for practicing the invention. These embodiments will be described in sufficient detail to enable those skilled in the art to practice the invention, and it is understood that other embodiments may be utilized and that structural changes may be made without departing from the scope of the invention. The following detailed description is, therefore, not to be taken in a limiting sense.

BRIEF DESCRIPTION OF THE DRAWINGS

In the drawings wherein like reference numberals represent like parts:

FIG. 1 is a perspective view of an embodiment of a toothbrush constructed according to the teachings of this invention;

FIG. 2 is an end, vertical sectional view showing the toothbrush of FIG. 1 in a cleaning position around a tooth;

FIG. 3 is a side, vertical sectional view taken on the line 3—3 of FIG. 1.

FIG. 4 is a perspective view of another embodiment of a toothbrush constructed according to the teachings of this invention.

FIG. 5 is a perspective view illustrating another method of constructing a toothbrush according to the techniques of this invention.

DETAILED DESCRIPTION OF PREFERRED EMBODIMENTS

Figure 6:
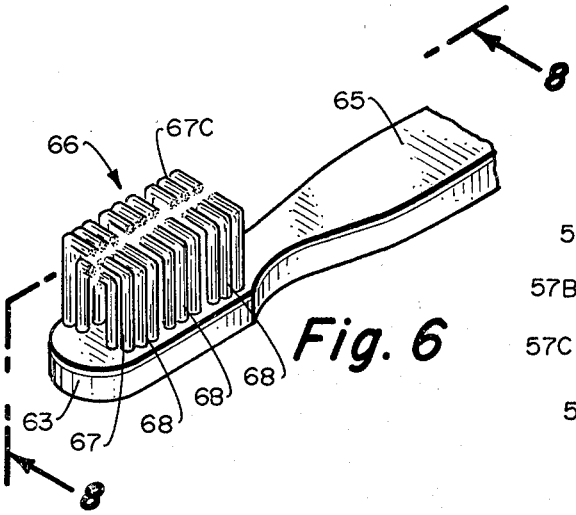
FIG. 6 is a top perspective view of a third embodiment of this invention.

The present invention is directed to a single head toothbrush capable of simultaneously brushing the buccal and lingual surfaces of the teeth, in one operation. The present invention accomplishes this by providing a toothbrush having a holder, a bristle mounting head and a plurality of bristles and wherein the bristles are arranged angularly or in arcuate shaped bundle having one or more tufts emanating from a bristle mounting head so that the ends or tips of the bristles at one end of one bundle can brush against the buccal surfaces of the teeth while the ends or tips of the bristles at the other end of the bundle brush against the lingual surfaces of the teeth.

Referring now to FIGS. 1 through 3 and especially FIG. 1, there is shown an embodiment of a toothbrush constructed according to the teachings of this invention and identified generally by reference numeral 11.

In this embodiment the toothbrush 11 includes a bristle mounting head 13, a bundle 15 for supporting the bristle mounting head 13 and which is integrally formed with the bristle mounting head 13 and a plurality of bristles 17 which are attached to the bristle mounting head. The integrally formed bristle mounting head 13 and bundle 15 are made by any suitable material such as a thermoplastic. The plurality of bristles 17 are bonded together into an arcuate shaped bundle 16 and is secured over an area 19 intermediate the ends to the bristle mounting head 13 by any suitable means such as glue 10. As can be seen, the arcuate shaped bundle defines essentially a section of a cylinder with the opening between the ends of the section corresponding approximately to the thickness of the teeth. The bristles 17 may be formed of any suitable material such as nylon filaments and are bonded together by any suitable means such as by the application of heat or by an appropriate solvent. The bristles include both a proximal end and a distal end. The proximal ends of all of said bristles are disposed in said head to extend upwardly in the same general direction along each row of bristles from said head on one side thereof. The distal ends of all of the bristles in the outer rows of bristles are directed inwardly in a generally transverse direction from said generally upward direction toward each other.

As can be seen in FIG. 2, when the bundles 16 of bristles 17 are placed about a tooth T to be cleaned, the ends 17-1 and 17-2 rub against the front and back surfaces of the tooth T.

As can be appreciated, the novel brush arrangement is not limited to hand operated or manually operated toothbrushes but may apply to electric toothbrushes as well. Thus, as shown, in FIG. 4 the toothbrush 21 includes a head 23 having bristles 17, a shank 25 integrally formed with the bristle mounting head 23 for connection to the base of an electric toothbrush (not shown). Two bundles that are contiguous, as here, constitute a monobundle.

An arcuate mono-bundle of bristles may be formed by winding a nylon monofilament back and forth over a mandrel a suitable number of times, such as five or six, setting the windings in the cylindrical shape such as by heat bonding the windings together, such as by heat or by the application of a suitable adhesive, removing the wound and bonded monofilament from the mandrel and then cutting away a section aimed approximately equal to the width of teeth.

The bundle so formed is then attached to the bristle mounting head of a toothbrush by any appropriate means, such as an adhesive. Reference is made in the FIG. 2 configuration.

In FIG. 5, another version of attaching the fused monofilament bundle of bristles 17 to a head 33 is shown. Here the bundle 17 is placed into a mould and plastic injected therein. The plastic hardens around the bristles sealing them into and forming a head 33. Injection moulding of plastics is a well known technique.

Figure 10:
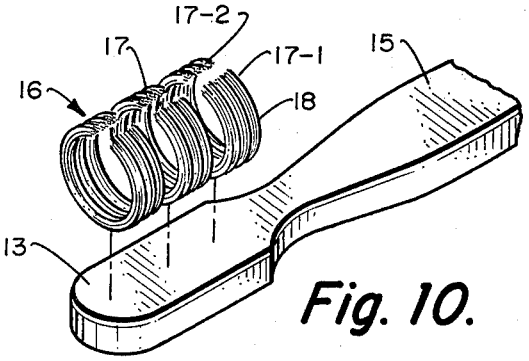
FIG. 10 is an exploded view of a variant of the toothbrush of FIG. 1.

As used herein, the term mono-bundle encompasses a brush head having two useable bundles of bristles, having one or more tufts, the bristles of which are joined at one end to an end of its correspondingly opposed bristle. A tuft is seen to be a plurality of individual bristles closely associated together at the lower ends and loose at their upper ends. In the embodiments previously discussed, each of the two bundles forming the monobundle consisted of only one tuft. The use of a plurality of tuft construction based on the embodiments shown in FIGS. 1 to 5 is contemplated and would be constructed from two or more mandrel windings butted up to each other end to end. The winding, however, would not be in pure coil configuration, but would require overlapping of winds at one point to yield a tuft like configuration. Reference is made to FIG. 10 which illustrates such a toothbrush in one exploded view to illustrate the winding mode.

Figure 7:
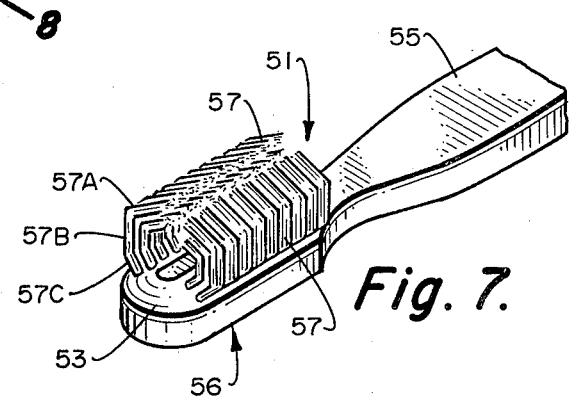
FIG. 7 is a perspective view of an embodiment similar to FIG. 5. The difference being the bend in the bundles.

In FIG. 7, which illustrates an embodiment similar to that of FIG. 5, there is shown a brush 51 having a head 53 and handle 55 integrally formed with head 53. Emanating from each side of head 53 is a bundle of bristles 56 consisting of a plurality of individual bristles 57. These bristles 57 each have an outwardly extending portion 57A, a downwardly extending second portion 57B and an inwardly extending third portion 57C. Each portion 57C is spaced from and opposed to its correspondingly opposite member, such that both the lingual and buccal surfaces of a tooth may be simultaneously cleansed. The embodiment of FIG. 7 may be fashioned in like manner as that of FIG. 5, except that further processing of the bristle bundles 56 is required to achieve the exact two bends in the individual filaments or bristle 57. Processing can be carried out by subjecting the bristles to deformation under steam in a mold of proper configuration.

Figure 9:
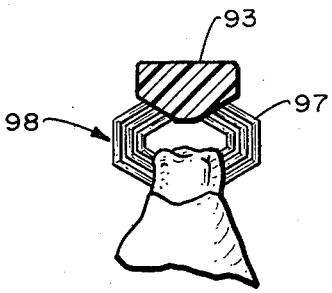
FIG. 9 is a front elevational view of another embodiment similar to that of FIG. 7 cleaning a tooth.

In FIG. 9 there is shown another embodiment of the improved toothbrush of this invention. In this embodiment, both surfaces of the tooth was previously discussed can be simultaneously cleaned. This embodiment differs from that of FIG. 7 only in the fact that the individual bristles 97 are collected into a plurality of tufts one of which 98 is seen on each side of head 93 in this front elevational view.

Figure 8:
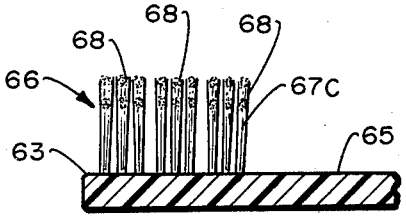
FIG. 8 is a side elevational view taken on the line 8—8 of FIG. 6.

In FIG. 6, there is shown a top perspective view of a toothbrush in accordance with this invention wherein the angular bristles are set out in a plurality of tufts 68. The two bundles of bristles 66 are seen to be paralled at their point of origin in head 63 and spaced and opposed at the extreme portion of each bristle 67C. A space is maintained between the two rows of tufts forming the bundles. Optionally however, not shown, low vertical bristles, tufted or not may be disposed between the opposed bristle 67 to clean the biting surface of the tooth while the linguals and buccals are being cleaned. The tufting of the bristles 67 is better seen in FIG. 8 which is a side elevational view of brush of FIG. 6.

In FIG. 10, a brush similar to that of FIG. 1 is shown, the difference being that a plurality of mono-bundles 16 are employed in a tufted format. Thus the dual designator 18 as well.

In order to fashion such a pseudo-tufted mono-bundle, the winding over the mandrel as previously described must be overlapped along part of the extension of the winding such that the plurality of bristles 17 can have a common point of beginning.

Figure 11:
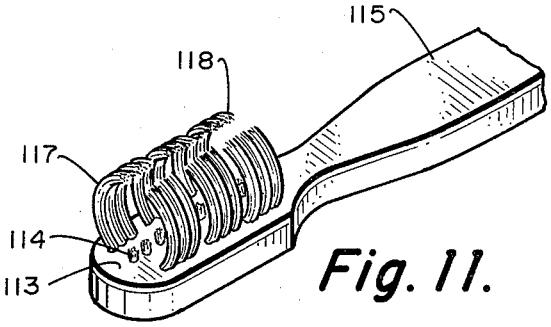
FIG. 11 is a top perspective view of another embodiment of this invention related to the embodiment of FIG. 6.

In FIG. 11, there is shown a top perspective view of an embodiment similar to that of FIG. 6 in that it uses a standard brush head 113 with bristles 117 in a plurality of tufts 118, said bristles being vertically disposed therein. As seen, the bristles 117 are arcuate in configuration and spaced apart from their corresponding opposite mirror image member. A smaller vertical tuft 114 is shown as optional tuft between the main tufts. A plurality of these are set out in a row spaced equidistantly from the tufts 118 that feature arcuate bristles 117. A standard handle 115 is molded with the head 113.

Figure 12:
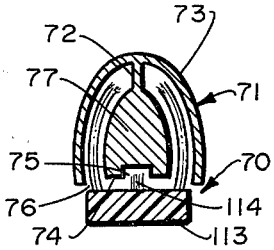
FIG. 12 is an elevational view illustrating the mode of invention of the device of FIG. 11.

In FIG. 12, a mold 71 made of metal or plastic, capable of resisting high temperatures is shown superposed upon a brush 70, which prior to insertion into and treatment within the mold had straight vertical tufted bristles. The mold 71 has an outer arcuate portion 73 and an inner arcuate member 77 spaced apart from each other and held together by spacer member 72. The cavity defined between member 77 and portion 73, designated 76, conforms to the ultimately desired configuration for the bristles, here arcuate. Member 77 has two projecting spaced apart bosses 74, the distance between them being space 75 which allows for the disposition of tuft 114 therethrough. Space 75 can be eliminated if tuft 114 is not employed.

After the mold is affixed to position, and the tufts deformed, steam at about 300° F. is inserted into the mold to permanently form the bristles with the desired configuration, here arcuate. A mold such as 71 properly configured would be used to create the brush of FIG. 6 as well. Other techniques to fuse the bristles into a specific configuration can also be employed.

While not shown here, it also is contemplated that special tips such as for pulling and massaging of gums, and plaque removal can be installed in the distant end of the handle, not shown in the drawings, as would be known to the art.

It will be understood that various changes in the details, materials, and arrangement of parts which have hereinafter been described and illustrated in order to explain the nature of the invention may be made by those skilled in the art within the principles and scope of the invention.

What is claimed is:

1. A toothbrush for simultaneously brushing the bucaal and lingual surfaces of the teeth in one brushing operation comprising:

a. an elongated handle b. a bristle mounting head formed as a planar continuation of said handle, c. a plurality of cleaning bristles, having distal and proximal ends, arranged in three longitudinal parallel rows all of which rows run parallel to the length of the handle, the proximal ends of all of said bristles being disposed in said head and extending upwardly in the same general direction along each row from said head from one side thereof, the distal ends of all of the bristles in the outer rows of bristles being directed inwardly in a generally transverse direction from said generally upward direction toward the inner row of bristles, the inner row of bristles being straight and shorter in height than the outer rows of bristles, the outer rows being of uniform bristle height.

2. The toothbrush as in claim 1 wherein the bristles are arranged in tufts within said parallel rows of bristles.

3. The toothbrush of claim 1 wherein the bristles of the outer rows are arcuate from proximal end to distal end.

4. The toothbrush of claim 2 wherein the bristles of the outer rows are arcuate from proximal end to distal end.

5. The toothbrush of claim 1 wherein the distal ends of the bristles of the outer rows are disposed at about a right angle inwardly toward the space between the rows.

6. A toothbrush for simultaneously brushing the bucaal and lingual surfaces of the teeth in one brushing operation comprising:

a. an elongated handle b. a bristle mounting head formed as a planar continuation of said handle, c. a plurality of cleaning bristles, having distal and proximal ends, and an intermediate portion, said bristles being arranged in two longitudinal spaced parallel rows both of which rows run parallel to the length of the handle, the proximal ends of said bristles being disposed in said head whereby said bristles extend from said head;

the proximal ends of said bristles extending angularly outward from said head, the intermediate portion of said bristles being vertically disposed, and the distal ends of said bristles being directed angularly inwardly toward the space therebetween.

7. The toothbrush of claim 1 wherein the distal ends of all of the bristles of the outer rows of bristles are directed arcuately inwardly.

* * * * *